US011674242B2

(12) United States Patent
Bai et al.

(10) Patent No.: US 11,674,242 B2
(45) Date of Patent: Jun. 13, 2023

(54) FABRICATION, APPLICATION AND APPARATUS OF FIBERS WITH ALIGNED POROUS STRUCTURE

(71) Applicant: ZHEJIANG UNIVERSITY, Zhejiang (CN)

(72) Inventors: Hao Bai, Zhejiang (CN); Ying Cui, Zhejiang (CN); Yujie Wang, Zhejiang (CN); Weiwei Gao, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 547 days.

(21) Appl. No.: 16/817,630

(22) Filed: Mar. 13, 2020

(65) Prior Publication Data

US 2020/0208303 A1 Jul. 2, 2020

Related U.S. Application Data

(63) Continuation of application No. PCT/CN2018/096755, filed on Jul. 24, 2018.

(30) Foreign Application Priority Data

Jan. 3, 2018 (CN) ..... 201810004795.1
Apr. 10, 2018 (CN) ..... 201810316005.3
Apr. 17, 2018 (CN) ..... 201810342589.1

(51) Int. Cl.
*D01D 5/247* (2006.01)
*D01D 1/02* (2006.01)
(Continued)

(52) U.S. Cl.
CPC ..... *D01D 5/247* (2013.01); *D01D 1/02* (2013.01); *D01F 1/07* (2013.01); *D01F 6/82* (2013.01); *D03D 15/513* (2021.01); *D03D 15/52* (2021.01)

(58) Field of Classification Search
CPC ..... D01D 5/247; D01D 1/02; D01D 7/00; D01D 5/00; D01D 10/02; D01D 13/00;
(Continued)

(56) References Cited

U.S. PATENT DOCUMENTS 5,719,253 A * 2/1998 Echigo ..... C08G 73/1032 528/188

FOREIGN PATENT DOCUMENTS

CN 102041577 5/2011
CN 102584211 7/2012
(Continued)

OTHER PUBLICATIONS

Machine English translation of CN 102584211, Accessed Dec. 13, 22 (Year: 2013).*

(Continued)

*Primary Examiner* — Jacob T Minskey
*Assistant Examiner* — Adrianna N Konves
(74) *Attorney, Agent, or Firm* — JCIPRNET

(57) ABSTRACT

Provided is a method of manufacturing fiber with aligned porous structure, an apparatus, and applications of the fiber. The apparatus comprises: a fiber extrusion unit, a freezing unit, and a collection unit for collecting the frozen fibers, wherein fibers extruded from the fiber extrusion unit pass through the freezing unit. Continuous and large scale preparation of such fiber with aligned porous structure is achieved by combining directional freezing and solution spinning.

4 Claims, 13 Drawing Sheets

(51) Int. Cl.

| | |
|---|---|
| ***D01F 1/07*** | (2006.01) |
| ***D01F 6/82*** | (2006.01) |
| ***D03D 15/513*** | (2021.01) |
| ***D03D 15/52*** | (2021.01) |

(58) Field of Classification Search
CPC ..... D01F 1/07; D01F 6/82; D01F 9/00; D01F 4/02; D03D 15/513; D03D 15/52
See application file for complete search history.

(56) References Cited

FOREIGN PATENT DOCUMENTS

| | | | | | |
|---|---|---|---|---|---|
| CN | 202450199 | | | 9/2012 | |
| CN | 105903085 | A | * | 8/2016 | ..... A61L 27/26 |
| JP | S5281120 | | | 7/1977 | |
| JP | H0450313 | A | * | 2/1992 | |
| JP | 2006007224 | A | * | 1/2006 | |

OTHER PUBLICATIONS

Machine English translation of CN 105903085, Accessed Dec. 13, 22 (Year: 2016).*
Machine English translation of JP2006007224A, Accessed Dec. 13, 22 (Year: 2008).*
Machine English translation of JPH0450313A, Accessed Dec. 13, 22 (Year: 1992).*

* cited by examiner

FABRICATION, APPLICATION AND APPARATUS OF FIBERS WITH ALIGNED POROUS STRUCTURE

CROSS-REFERENCE TO RELATED APPLICATION

This application is a continuation of international PCT application serial no. PCT/CN2018/096755, filed on Jul. 24, 2018, which claims the priority benefit of China application no. 201810004795.1, filed on Jan. 3, 2018, China application no. 201810316005.3, filed on Apr. 10, 2018, China application no. 201810342589.1, filed on Apr. 17, 2018. The entirety of each of the above mentioned patent applications is hereby incorporated by reference herein and made a part of this specification.

BACKGROUND OF THE DISCLOSURE

1. Field of the Disclosure

The present invention related to the fabrication of porous fibers. More particularly, the present invention relates to a fabrication, an application and an apparatus of fibers with aligned porous structure.

2. Description of Related Art

Spinning device is machines that turn polymer solution or melt into fibers. According to the difference in spinning process, traditional spinning methods are divided into wet spinning, dry spinning and melt spinning.

Wet spinning is a technique that spinning solution is extruded from spinneret into coagulation bath where polymer is separated out to form nascent fibers. This technique requires a wide variety of equipment which is usually bulky to prepare spinning solution and make other pre-spinning preparation, as well as coagulation bath and recycling equipment. The technological process of this spinning method is complex, and it requires high cost of plant construction and equipment investment. At the same time, the spinning speed is relatively low. Therefore, the total cost is high.

Dry spinning is a technique that spinning solution is extruded from spinneret into tunnel where solvent of the solution evaporates rapidly under the influence of hot air and the solution is concentrated and cured to form nascent fibers. Drying spinning is suitable for processing polymer which decomposes at a temperature lower than its melting temperature or changes color while be heated but which can be dissolved in suitable solvent. However, this spinning method requires many auxiliary equipment, and the cost is high.

Melting spinning is a technique that polymer is heated to melt and then extruded from spinneret into air where the polymer cools and cures to form fibers. This spinning method doesn't require solvent and coagulation bath. The equipment is relatively simple, and the process is short. However, the equipment requires high voltage and high operating temperature.

Directional freezing is a method of obtaining aligned porous materials through using temperature gradient to influence and control the movement and assembly of ingredient. In recent years, many types of aligned porous materials have been successfully fabricated by directional freezing. Deville et al. (S. Deville, E. Saiz, A. P. Tomsia, Biomaterials 2006, 27, 5480.) successfully fabricated hydroxyapatite scaffold with aligned structure which makes the material possesses greater compressive strength than other structures. Wicklein et al. (B. Wicklein, A. Kocjan, G. Salazar-Alvarez, F. Carosio, G. Camino, M. Antonietti, L. Bergstrom, Nat. Nanotechnol. 2014, 10, 27791) fabricated graphene/cellulose composite scaffold by directional freezing. And the presence of the aligned structure gives the material better thermal-insulating and fire-retardant property.

However, traditional directional freezing cannot fabricate fibers with aligned porous structure because of the defects of the apparatus and process. Continuous and large-scale fabrication also cannot be achieved. These above drawbacks severely limit the use of directional freezing in fabrication of porous fibers.

SUMMARY OF THE DISCLOSURE

The technical problem to be solved by this invention is how to achieve continuous and large-scale fabrication of fibers with aligned porous structure.

The technical proposal provided by this invention is an apparatus for fabricating fibers with aligned porous structure, which comprises a fiber extrusion unit, a freezing unit, and a collection unit for collecting the frozen fibers, wherein fibers extruded from the fiber extrusion unit pass through the freezing unit.

In the above technical proposal, the apparatus is designed to fabricate aligned porous fibers by combining directional freezing and solution spinning. The spinning solution is extruded from the extrusion unit and then passes through the freezing unit. There is temperature gradient in the direction perpendicular to the freezing unit, which influences and controls the nucleation and growth of ice crystal along the direction of temperature gradient. Meanwhile, due to the micro-phase separation of the system, the ingredient is squeezed and compressed in the gap between the ice crystals. The frozen fibers are collected by the collection unit and then freeze-dried to remove ice crystal. Thus, fibers with aligned porous structure using ice crystal as template are obtained. And the above apparatus can achieve continuous and large-scale fabrication of the porous fibers.

The fiber extrusion direction of this invention can be vertical, or horizontal, or any other direction.

The freezing unit of this invention includes freezing ring connected to the cold source. The freezing ring is made of thermally conductive metal such as copper and aluminum. There is temperature gradient in the direction perpendicular to the freezing ring. Preferably, the freezing unit includes copper ring connected to the cold source. More preferably, the copper ring is made of red copper. The thermal conductivity is 386.4 W/(m·K), which means the copper ring has excellent thermal conductivity.

Preferably, the temperature of the freezing ring is any temperature below the freezing point of the solvent.

Preferably, the temperature of the freezing ring is −120 to −30° C. More preferably, the temperature is −100° C.

Preferably, the freezing ring includes an annular freezing section and a thermally conductive section which is connected to a cold source. The freezing section is mainly for providing temperature gradient perpendicular to itself, and the thermally conductive section controls the temperature of the freezing section.

As a preferred option, the freezing unit includes a freezing tank in which the refrigerating fluid is stored, and the freezing tank is thermally conductive. The thermally conductive section of the freezing ring connects to the wall of the freezing tank. And the freezing ring is located above the refrigerating fluid, that is to say, the freezing ring is in contact with the refrigerating fluid indirectly through thermal-conductive tank wall. The freezing tank is made of thermally conductive metal such as copper and aluminum. More preferably, the freezing tank is made of red copper. The thermal conductivity is 386.4 W/(m·K), which means the freezing tank has excellent thermal conductivity.

As a preferred option, the freezing unit includes a freezing tank in which the refrigerating fluid is stored, and the freezing tank is thermally conductive. The thermally conductive section of the freezing ring connects to the wall of the freezing tank and contacts with the refrigerating fluid directly. The freezing tank is made of thermally conductive metal such as copper and aluminum. More preferably, the freezing tank is made of red copper. The thermal conductivity is 386.4 W/(m·K), which means the freezing tank has excellent thermal conductivity.

As a preferred option, the freezing unit includes a freezing tank in which the refrigerating fluid is stored, and the freezing tank is thermal-insulating. The thermally conductive section of the freezing ring, which connects to the bottom of the freezing tank, is in contact with the refrigerating fluid directly. The freezing tank is made of thermal-insulating material such as glass and Teflon.

As a preferred option, the freezing unit includes a freezing tank with interlayer which is composed of walls of the freezing tank. The refrigerating fluid is stored in the interlayer. The freezing tank is thermally conductive. And the thermally conductive section of the freezing ring connects to the wall of the freezing tank. More preferably, the thermally conductive section of the freezing ring is set in the cavity of the freezing tank. The freezing tank is made of thermally conductive metal such as copper and aluminum. More preferably, the freezing tank is made of red copper. The thermal conductivity is 386.4 W/(m·K), which means the freezing tank has excellent thermal conductivity.

Preferably, the refrigerating fluid is liquid with low freezing point, such as aqueous solution of ethanol, ethylene glycol, and so on.

Preferably, the freezing tank is provided with a refrigerating system for controlling the temperature of the refrigerating fluid.

Preferably, the refrigerating system is a low-temperature thermostat bath which connects to the freezing tank through refrigerating fluid circulating pipe. The refrigerating fluid circulating pipe connects between the freezing tank and the refrigerating system. The refrigerating fluid flows among the refrigerating system, the refrigerating fluid circulating pipe and the freezing tank to form a closed circuit. The closed circuit of the refrigerating fluid maintains a low temperature environment in the freezing tank.

Preferably, the fiber extrusion unit includes an extruder and a pump that powers the extruder. The pump is syringe pump. The syringe pump controls the flow rate of the spinning solution by squeezing the piston of the syringe. The flow rate can be selected from 0.01 μl/min to 100 ml/min. More preferably, the flow rate is 0.05 ml/min.

Preferably, the extruder connects to multi-nozzle spinneret, and a corresponding number of copper rings are set. The freezing section of each copper ring is aligned with a nozzle of the multi-nozzle spinneret for directionally freezing the fibers which pass through the copper ring.

Preferably, the extruder is syringe. Syringes with ranges from 10 μl to 100 ml can be selected. More preferably, syringe with a range of 20 ml is selected.

Preferably, the collection unit includes a motor and a collecting roller driven by the motor. The existing control system can be used to control the rotational rate of the motor. The frozen fibers are rotated to realize continuous collection.

The technical problem to be solved by this invention is providing a method combining directional freezing with solution spinning to fabricate fibers with aligned porous structure. The fibers have excellent thermal-insulating property because of its aligned porous structure.

The technical proposal provided by this invention is a method of fabricating fibers with aligned porous structure, which includes the following steps. (1) Mix the silk fibroin solution with chitosan solution to prepare spinning solution. (2) Use the as-prepared solution for solution spinning, perform directional freezing process during the solution spinning, and collect the frozen fibers. The directional freezing process includes: the spinning solution passing through the freezing copper ring after being extruded from the extruder. Water is frozen directionally in the direction of temperature gradient under the temperature field. (3) Freeze-dry the frozen fibers to remove ice crystal and then obtain fibers with aligned porous structure.

In the above proposal, fibers fabricated by directional freezing and solution spinning have aligned porous structure, thus they have excellent thermal-insulating property. The spinning solution is extruded from the syringe, and then the nucleation and growth of ice crystal are oriented due to the influence of the temperature gradient. Meanwhile, due to the micro-phase separation of the system, the ingredient is squeezed and compressed in the gap between the ice crystals. The frozen fibers are freeze-dried to remove ice crystal. Thus, fibers with aligned porous structure using ice crystal as template are obtained.

Preferably, the preparation of silk fibroin solution in step 1 comprises: shearing natural silk cocoons, boiling the silk cocoons in sodium carbonate solution and then drying them, dissolving them in lithium bromide solution, and dialyzing completely to make the silk fibroin solution.

Preferably, the preparation of chitosan solution in step 1 is through dissolving the chitosan powder in acetic acid solution. The concentration of the as-prepared solution is 40 to 60 mg/ml. More preferably, the mass concentration of the acetic acid solution is 0.5 to 1.5%.

Preferably, the mass ratio of silk fibroin and chitosan is 8 to 10:1 in step 1. More preferably, the ratio is 9:1. The mechanical and thermal-insulating property of the fibers can be controlled by adjusting the mass ratio of silk fibroin and chitosan in spinning solution. The ratio has great influence on the strength, elongation and thermal-insulating property of the fibers. When the silk fibroin ratio is too high, the strength and elongation of fibers will be low, which influences the weaving. However, when the chitosan ratio is too high, the thermal-insulating property of fibers will be not satisfactory, because the silk fibroin is a more ideal material for thermal insulation. Considering both the mechanical and thermal-insulating property, it is found that when the mass ratio of silk fibroin and chitosan is 9:1, the fibers possess excellent thermal-insulating and mechanical property at the same time.

Preferably, carbon nanotube solution is added when the spinning solution is prepared in step 1. The mass ratio of silk fibroin and carbon nanotube is 200 to 250:1. More preferably, the ratio is 225:1. The addition of carbon nanotube make the fibers have electrothermal property.

When a voltage is applied, the fiber's own temperature rises. More preferably, the carbon nanotube solution is prepared by dispersing carbon nanotube in a sodium dodecylbenzene sulfonate solution. The concentration of carbon nanotube solution is 0.5 to 1.5 mg/ml. The volume concentration of sodium dodecylbenzene sulfonate solution is 0.5 to 1.5%.

Preferably, the temperature of the freezing copper ring in step 2 is any temperature below the freezing point of the solvent. Preferably, the temperature of the freezing copper ring is −100 to −40° C. The freezing temperature has influence on the aligned porous structure. The lower the temperature is, the larger the temperature gradient is, the faster the ice crystal grows and the smaller the pore diameter is. Conversely, the high the temperature is, the smaller the temperature gradient is, the slower the ice crystal grows and the larger the pore diameter is.

This invention provides fibers with aligned porous structure prepared by the above method.

This invention provides fibers with aligned porous structure fabricated by the above method to be used as thermal-insulating materials.

This invention provides fibers with aligned porous structure fabricated by the above method to be used as thermal stealth materials. Due to the excellent thermal-insulating property of the porous fibers, the object will not be detected by the infrared camera when the difference between the object temperature and background temperature is small. So the fibers can be used as thermal stealth materials.

This invention provides fibers with aligned porous structure fabricated by the above method to be used as electric heating materials. Conducting material such as carbon nanotube is added to the fibers, which makes the fibers possess electrothermal property. When a voltage is applied, the fiber's own temperature rises, and thus it can be used for human thermoregulation. The fibers can not only actively release heat, but also insulate heat, thereby saving and storing energy. The fibers can be widely used in human wearable devices, building materials protection, military, and other fields, with broad prospects for development.

The technical problem to be solved by this invention is fabricating fibers with aligned porous structure along the axial direction which possess excellent thermal-insulating and fire-retardant property.

The technical proposal provided by this invention is polyimide fibers which are thermal-insulating at high temperature and fire-retardant. The fibers possess aligned and continuous through-hole along the axial direction. Because of the aligned porous structure along the axial direction, the polyimide porous fibers possess excellent thermal-insulating and fire-retardant property.

The pore diameter of the fibers with aligned porous structure in this invention is 10 to 100 μm.

A textile woven by the above-mentioned polyimide fibers which are thermal-insulating at high temperature and fire-retardant is provided by this invention.

This invention provides a method of fabricating the above-mentioned polyimide fibers, which includes the following steps. (1) Use the poly(amic acid) hydrogel for spinning, perform a directional freezing process during spinning, and collect the frozen fibers. The directional freezing process includes: the hydrogel passes through the freezing copper ring after being extruded from the extruder. Water is frozen directionally in the direction of temperature gradient under the temperature field. (2) Freeze-dry the frozen fibers to remove ice crystal and then obtain fibers with aligned porous structure. (3) Heat the as-prepared fibers to realize the complete imidization of poly(amic acid) into polyimide.

This invention realizes continuous and large-scale fabrication of polyimide fibers by "directional freezing-solution spinning" method, and the fibers are thermal-insulating at high temperature and fire-retardant. The hydrogel is extruded from the syringe and then frozen directionally. The nucleation and growth of ice crystal are oriented due to the influence of the temperature gradient. Meanwhile, due to the micro-phase separation of the system, the ingredient is squeezed and compressed in the gap between the ice crystals. The frozen fibers are freeze-dried to remove ice crystal. Thus, fibers with aligned porous structure using ice crystal as template are obtained.

Preferably, the mass fraction of the poly(amic acid) hydrogel is 3 to 20% in step 1. More preferably, the mass fraction is 5 to 15%.

The poly(amic acid) hydrogel is prepared by the existing method. Preferably, the preparation of the hydrogel in step 1 comprises: (1.1) dissolving 4,4'-diaminodiphenyl ether in N,N-dimethylacetamide with adding pyromellitic dianhydride and trimethylamine subsequently to obtain poly(amic acid) solid; (1.2) mixing the poly(amic acid) solid with trimethylamine and water to obtain poly(amic acid) hydrogel.

More preferably, the preparation of the poly(amic acid) hydrogel in step 1 specifically comprises the following steps. (1.1) Dissolve 4,4'-diaminodiphenyl ether in N,N-dimethylacetamide, add pyromellitic dianhydride and trimethylamine subsequently and stir to obtain poly(amic acid) solution. Pour the as-prepared solution into water to replace the solvent, and then freeze-dry the solution to obtain poly(amic acid) solid. (1.2) Mix the poly(amic acid) solid with trimethylamine and water, and stir to obtain poly(amic acid) hydrogel.

Preferably, the directional freezing process in step 1 is described below. The poly(amic acid) hydrogel is extruded from the syringe and then frozen directionally when it passes through the freezing copper ring. On the basis of traditional directional freezing, the method combines spinning solution. There is temperature gradient in the direction perpendicular to the copper ring. When temperature is lower than the crystallization temperature of the solvent, the solvent begins to crystallize. As a result, the ingredient is squeezed and compressed in the gap between the ice crystals.

Preferably, the temperature of the freezing copper ring is any temperature below the freezing point of the solvent. Preferably, the temperature of the freezing copper ring is −100 to −30° C. The freezing temperature has influence on the aligned porous structure. The lower the temperature is, the larger the temperature gradient is, the faster the ice crystal grows and the smaller the pore diameter is. Conversely, the high the temperature is, the smaller the temperature gradient is, the slower the ice crystal grows and the larger the pore diameter is.

Preferably, the thermal imidization in step 3 is through treating the fibers with three-stage heating and three-stage constant temperature processing. And the heating and constant temperature processing are performed alternately. More preferably, the thermal imidization in step 3 specifically includes: heating to 90 to 110° C. at a rate of 1 to 3° C./min, maintaining 25 to 35 min; heating to 190 to 210° C. at a rate of 1 to 3° C./min, maintaining 25 to 35 min; heating to 290 to 310° C. at a rate of 1 to 3° C./min, maintaining 55 to 65 min.

This invention provides polyimide fibers fabricated by the above method to be used as thermal-insulating and fire-retardant materials at high temperature.

Compared with the existing technology, the advantages of this invention are as follows. (1) The apparatus in this invention can fabricate fibers with aligned porous structure.

The pore diameter of fibers can be controlled by adjusting the temperature of the freezing unit. In addition, the porosity and micro-morphology can also be controlled. (2) The apparatus in this invention is simple and can realize continuous and large-scale fabrication of aligned porous fibers, which is suitable for industrial scale-up. And it can be designed to fabricate different materials according to the actual demand. (3) The fibers fabricated by the method in this invention have aligned porous structure which makes the fibers possess excellent thermal-insulating property as well as better mechanical property. (4) The polyimide fibers fabricated by the method in this invention have aligned porous structure, and they have excellent thermal-insulating and fire-retardant property.

DESCRIPTION OF THE EMBODIMENTS

The invention will be further illustrated by means of the following examples.

Example 1: Apparatus

Figure 1:
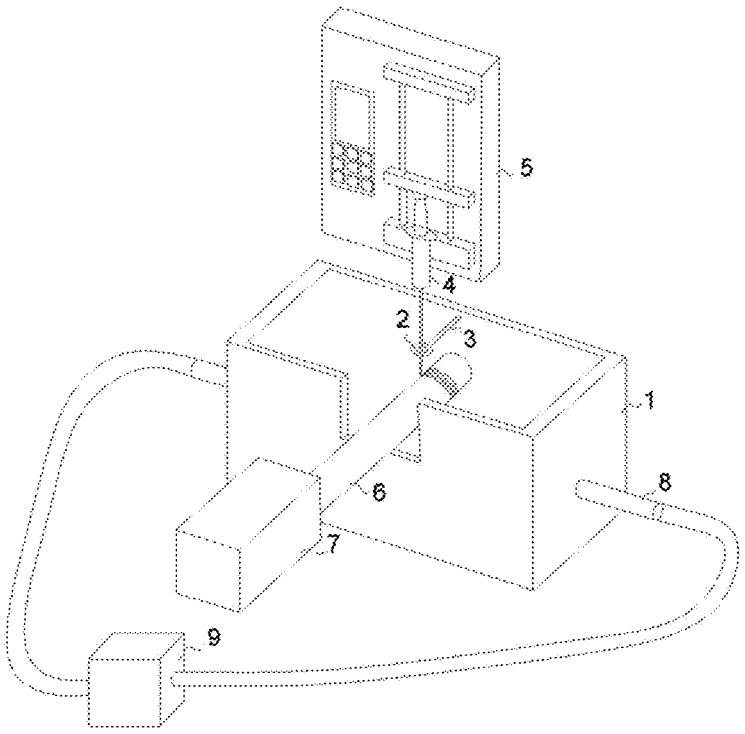
FIG. 1 shows the schematic diagram of apparatus in Example 1.

An apparatus for fabricating fibers with aligned porous structure is shown in FIG. 1, including fiber extrusion unit, freezing unit and collection unit.

The fiber extrusion unit comprises a syringe pump 5 and a syringe 4. The syringe 4 is mounted on the syringe pump 5 and controlled by the syringe pump 5 to extrude spinning solution. The syringe pump 5 may have a built-in control system or an external link control system (not shown in the figure) for controlling the flow rate. The syringe pump 5 controls the extrusion of the spinning solution by squeezing the piston of the syringe 4. The range of the syringe 4 is 20 ml, and the flow rate of the syringe pump 5 is selected to be 0.05 ml/min.

The freezing unit comprises a freezing tank 1, a refrigerating fluid circulating pipe 8, a refrigerating system 9 and a freezing copper ring. The refrigerating system 9 is a low-temperature thermostat bath. The freezing tank 1 is made of red copper. The thermal conductivity is 386.4 W/(m·K), which means the freezing tank has excellent thermal conductivity. The refrigerating system 9 connects to the freezing tank 1 through the refrigerating fluid circulating pipe 8. The refrigerating fluid circulates in the refrigerating system 9, the refrigerating fluid circulating pipe 8 and the freezing tank 1, which forms a closed circuit to maintain the low temperature environment in the freezing tank 1. The freezing copper ring comprises an annular freezing section 2 and a thermally conductive section 3. The thermally conductive section 3 is mounted on the wall of the freezing tank 1, such that the freezing copper ring is located above the refrigerating fluid and is not in direct contact with the refrigerating fluid. The freezing copper ring is made of red copper. And the temperature of the freezing copper ring may be any temperature below the freezing point of water, preferably −120 to −30° C., more preferably −100° C.

The collection unit comprises a collecting roller 6 and a motor 7. The collecting roller 6 is driven by the motor 7 to rotate slowly and collect fibers continuously.

The working process involves:

The spinning solution is extruded from the syringe 4 which is controlled by the syringe pump 5 and then passes through the freezing section 2. There is temperature gradient in the direction perpendicular to the freezing section 2, which influences and controls the nucleation and growth of ice crystal to be oriented along the direction of temperature gradient. Meanwhile, due to the micro-phase separation of the system, the ingredient is squeezed and compressed in the gap between the ice crystals. The frozen fibers are collected by the collecting roller 6 and then freeze-dried to remove ice crystal. Thus, fibers with aligned porous structure using ice crystal as template are obtained.

Example 2: Apparatus

Figure 2:
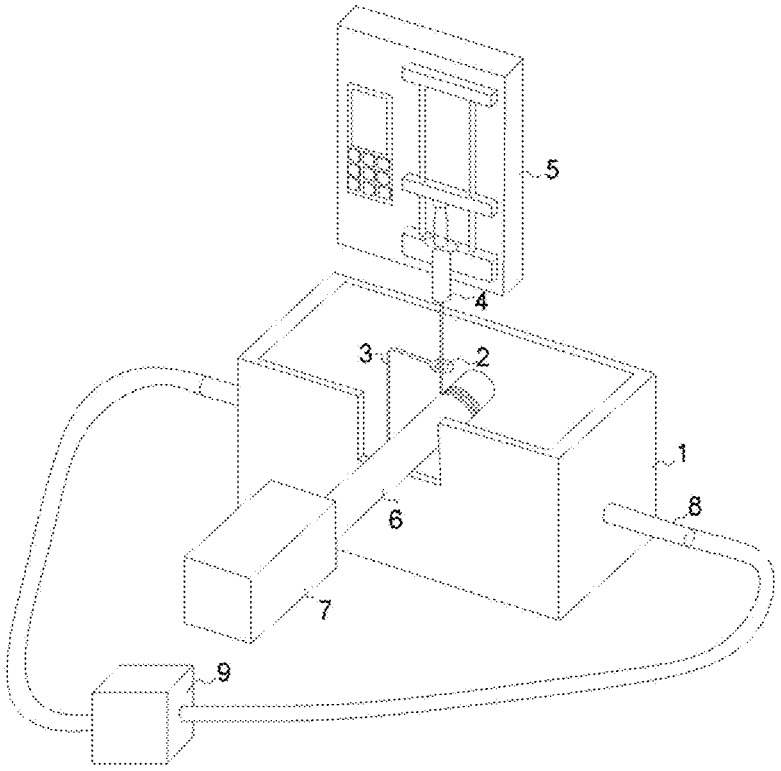
FIG. 2 shows the schematic diagram of apparatus in Example 2.

As shown in FIG. 2, the difference with Example 1 is that the freezing tank 1 is made of thermal-insulating material Teflon. The thermally conductive section 3 of the copper ring is set on the bottom of the freezing tank 1 and contacts directly with the refrigerating fluid which controls the temperature of the copper ring directly.

Example 3: Apparatus

Figure 3:
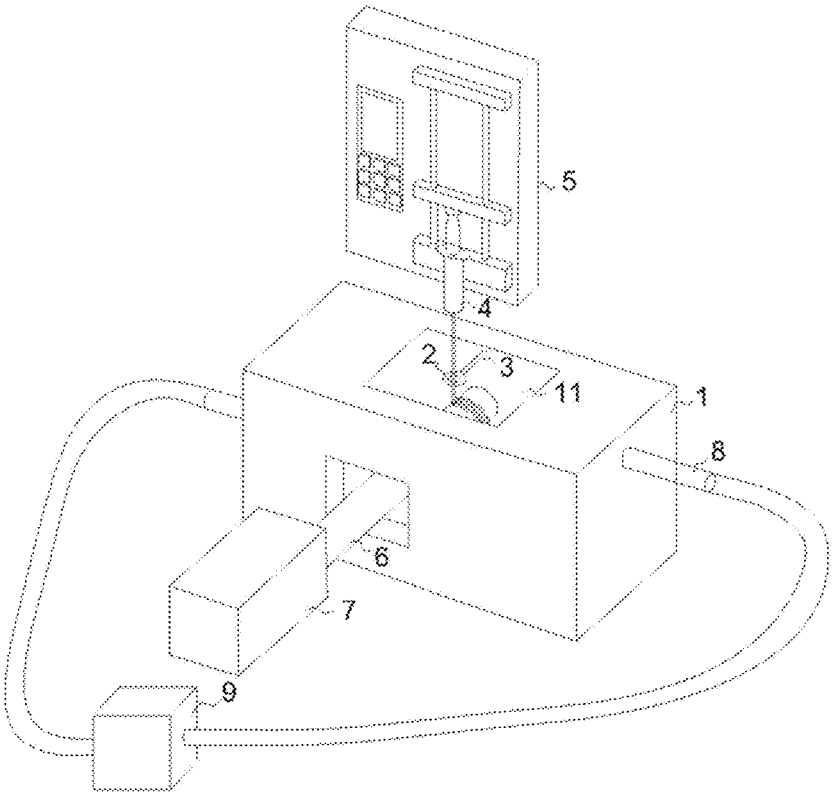
FIG. 3 shows the schematic diagram of apparatus in Example 3.
Figure 4:
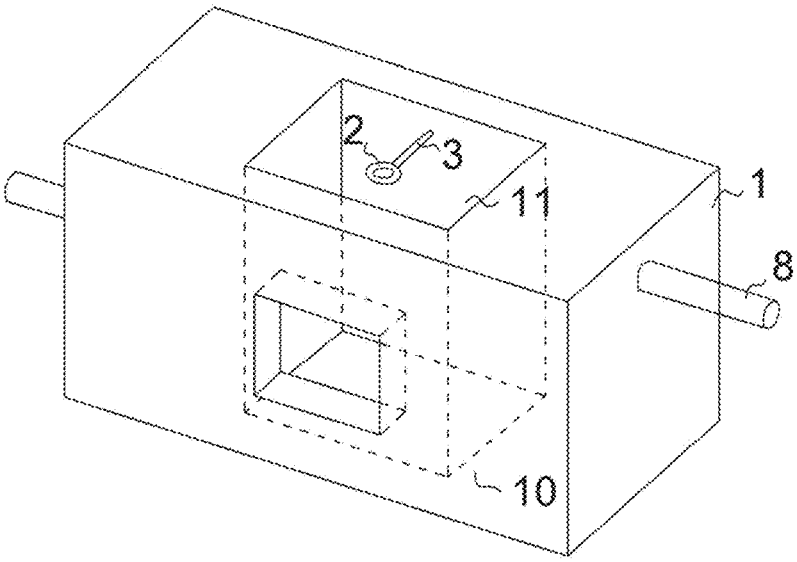
FIG. 4 shows the schematic diagram of freezing tank in Example 3.

As shown in FIG. 3 and FIG. 4, the difference with Example 1 is that the freezing tank 1 has interlayer structure which is composed of walls of the freezing tank 1. The refrigerating fluid is stored in the interlayer 10 to provide low temperature environment for cavity 11 in the freezing tank 1. The thermally conductive section 3 of the copper ring connects to the wall of the freezing tank 1, and the annular freezing section 2 is located in the cavity 11.

Example 4: Apparatus

Figure 5:
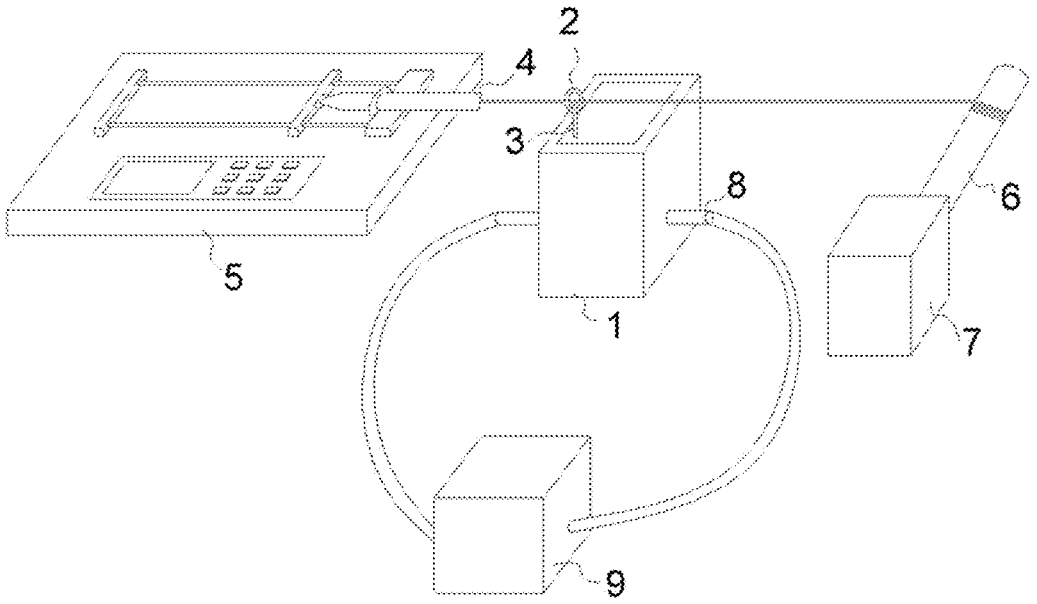
FIG. 5 shows the schematic diagram of apparatus in Example 4.

As shown in FIG. 5, the difference with Example 1 is that the syringe 4 and the syringe pump 5 are placed horizontally, while the copper ring is placed vertically. The thermally conductive section 3 of the copper ring connects to the wall of the freezing tank 1. And the fibers pass through the annular freezing section 2 horizontally. The whole freezing unit and collection unit are set at low temperature environment below 0° C. to avoid the ice crystal in fibers melting.

Example 5: Apparatus

Figure 6:
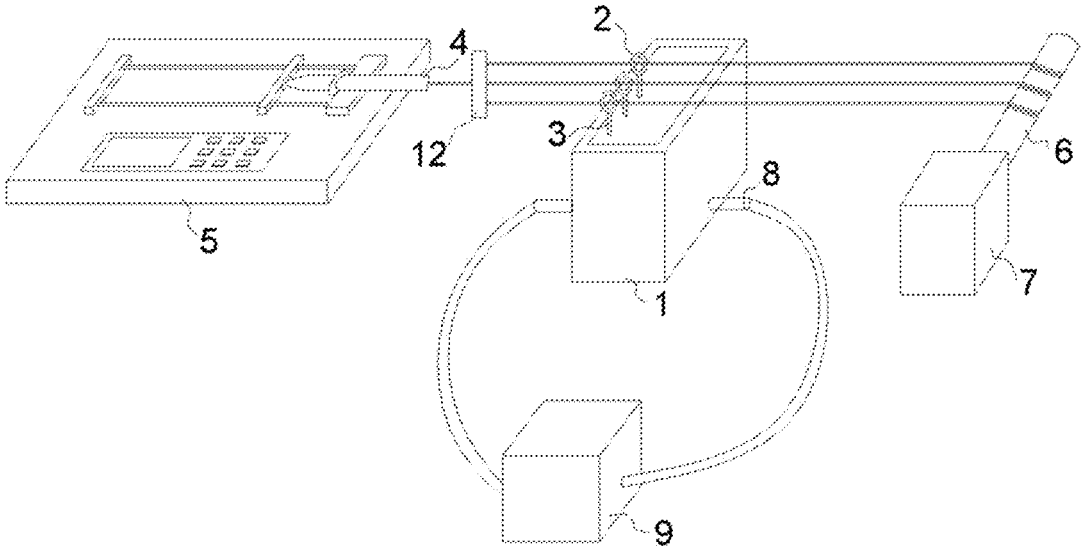
FIG. 6 shows the schematic diagram of apparatus in Example 5.

As shown in FIG. 6, the difference with Example 4 is that the syringe 4 connects to a multi-nozzle spinneret 12, and a corresponding number of copper rings are set side by side. The thermally conductive sections 3 of all the copper rings are mounted on the wall of the freezing tank 1. Multi strands of fibers pass through the annular freezing sections 2 and are collected by the collecting roller 6 simultaneously, realizing freezing and collection of multi strands of fibers.

Example 6: Fabrication of Porous Fibers

The apparatus in Example 1 is selected to fabricate fibers with aligned porous structure. The detailed method comprises the following steps.

(1) Shear 4.5 g of natural silk cocoons. Boil the cocoons in 1 wt % sodium carbonate solution and then dry them. Dissolve them in 20 ml of 9 mol/ml lithium bromide solution, and dialyze for 24 h to make a 0.225 g/ml silk fibroin solution.

Dissolve 0.5 g of chitosan powder in 10 ml of 1 wt % acetic acid solution, and stir for 30 min for complete dissolving to form a 0.05 g/ml chitosan solution with the rotator being 800 rpm/min.

Mix 20 ml of silk fibroin solution and 10 ml of chitosan solution, and centrifuge the mixture to get rid of bubbles to obtain a spinning solution. The mass ratio of silk fibroin and chitosan is 9:1.

(2) Load the syringe with the spinning solution which is then extruded by the pump. The temperature of the copper ring is −100° C. The spinning solution passes through the copper ring, and the frozen fibers are collected by a motor.

Figure 7:
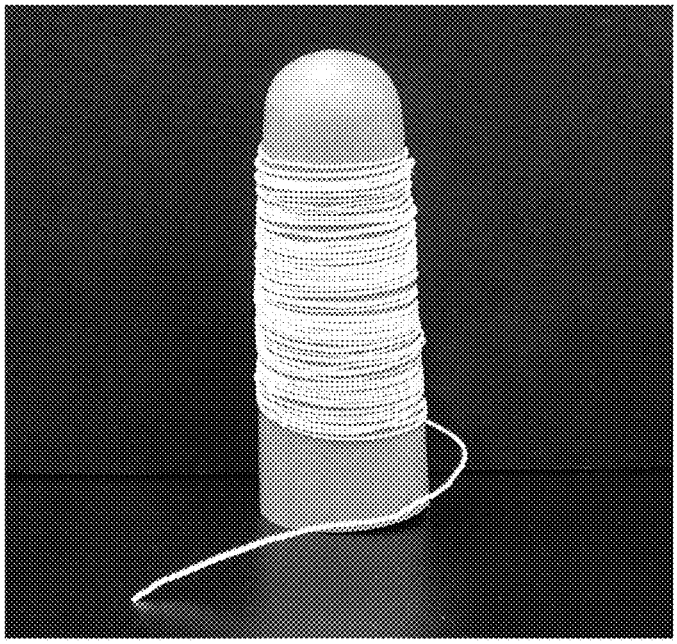
FIG. 7 shows the optical image of porous fiber fabricated in Example 6.

(3) Freeze-dry the fibers obtained in step 2 for 24 h to remove ice crystal and then obtain fibers with aligned porous structure. The optical image is shown in FIG. 7.

Figure 8:
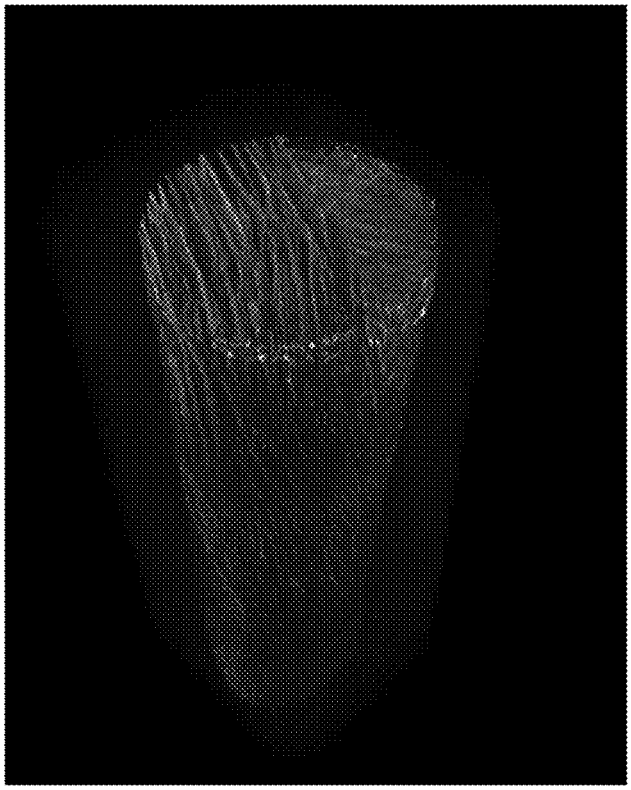
FIG. 8 shows the X-ray micro computed tomography (Micro-CT) image of porous fiber fabricated in Example 6.

(4) Characterize the porous fibers in the present example via Micro-CT. As shown in FIG. 8, the fiber has aligned porous structure.

Example 7: Fabrication of Porous Fibers

The apparatus in Example 1 is selected to fabricate fibers with aligned porous structure. The detailed method comprises the following steps.

(1) Shear 4.5 g of natural silk cocoons. Boil the cocoons in 1 wt % sodium carbonate solution and then dry them. Dissolve them in 20 ml of 9 mol/ml lithium bromide solution, and dialyze for 24 h to make a 0.225 g/ml silk fibroin solution.

Dissolve 0.5 g of chitosan powder in 10 ml of 1 wt % acetic acid solution, and stir for 30 min for complete dissolving to form a 0.05 g/ml chitosan solution with the rotator being 800 rpm/min.

Mix 20 ml of silk fibroin solution and 10 ml of chitosan solution, and centrifuge the mixture to get rid of bubbles to obtain a spinning solution. The mass ratio of silk fibroin and chitosan is 9:1.

(2) Load the syringe with the spinning solution which is then extruded by the pump. The temperature of the copper ring is −40, −60, −80, −100° C., respectively. The spinning solution passes through the copper ring, and the frozen fibers are collected by a motor.

(3) Freeze-dry the fibers obtained in step 2 for 24 h to remove ice crystal and then obtain fibers with aligned porous structure.

Figure 9:
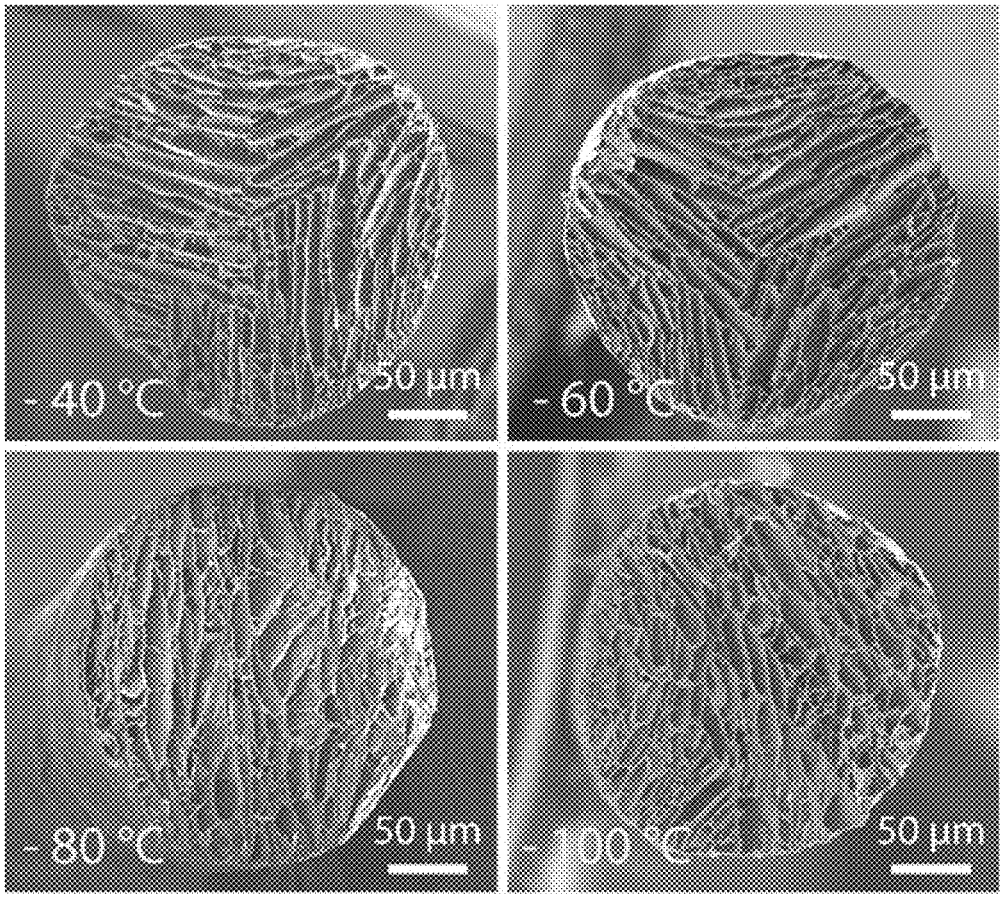
FIG. 9 shows the SEM image of porous fiber fabricated in Example 7.

(4) Characterize the porous fibers in the present example via scanning electron microscope (SEM). As shown in FIG. 9, the fibers have aligned porous structure.

Example 8: Fabrication of Porous Fibers

The apparatus in Example 2 is selected to fabricate fibers with aligned porous structure. The detailed method comprises the following steps.

(1) Shear 4.5 g of natural silk cocoons. Boil the cocoons in 1 wt % sodium carbonate solution and then dry them. Dissolve them in 20 ml of 9 mol/ml lithium bromide solution, and dialyze for 24 h to make a 0.225 g/ml silk fibroin solution.

Dissolve 0.5 g of chitosan powder in 10 ml of 1 wt % acetic acid solution, and stir for 30 min for complete dissolving to form a 0.05 g/ml chitosan solution with the rotator being 800 rpm/min.

Dissolve 0.01 g of carbon nanotube in 10 ml of 1 wt % sodium dodecylbenzene sulfonate solution. Mix 20 ml of silk fibroin solution, 10 ml of chitosan solution and 20 ml of carbon nanotube solution, and centrifuge the mixture to get rid of bubbles to obtain a spinning solution. The mass ratio of silk fibroin and chitosan is 9:1, and the mass ratio of silk fibroin and carbon nanotube is 225:1.

(2) Load the syringe with the spinning solution which is then extruded by the pump. The temperature of the copper ring is −100° C. The spinning solution passes through the copper ring, and the frozen fibers are collected by a motor.

(3) Freeze-dry the fibers obtained in step 2 for 24 h to remove ice crystal and then obtain fibers with aligned porous structure.

Figure 10:
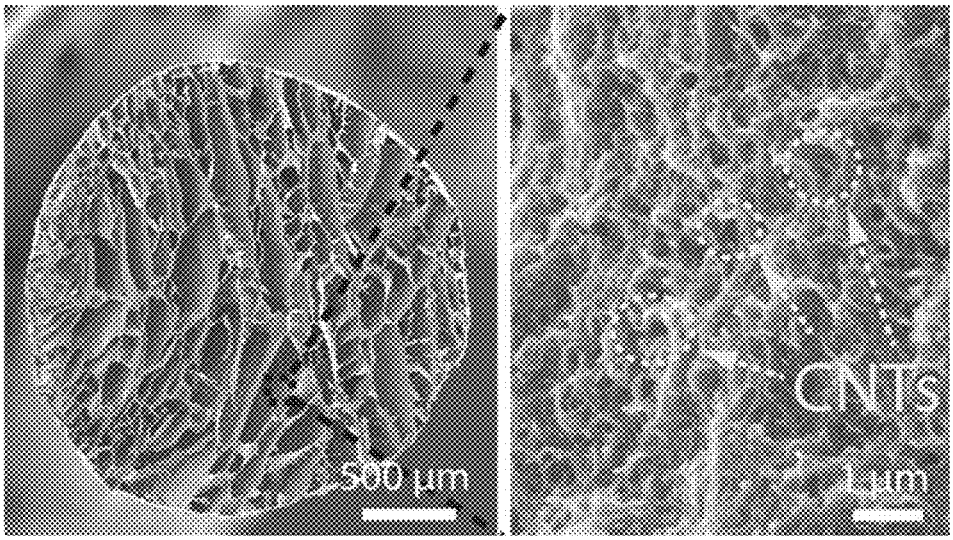
FIG. 10 shows the SEM image of porous fiber fabricated in Example 8.

(4) Characterize the porous fibers in the present example via SEM. As shown in FIG. 10, the fiber doped with carbon nanotube has aligned porous structure.

Example 9: Fabrication of Porous Fibers

The apparatus in Example 3 is selected to fabricate fibers with aligned porous structure. The detailed method comprises the following steps.

(1) Shear 4.5 g of natural silk cocoons. Boil the cocoons in 1 wt % sodium carbonate solution and then dry them. Dissolve them in 20 ml of 9 mol/ml lithium bromide solution, and dialyze for 24 h to make a 0.225 g/ml silk fibroin solution.

Dissolve 0.5 g of chitosan powder in 10 ml of 1 wt % acetic acid solution, and stir for 30 min for complete dissolving to form a 0.05 g/ml chitosan solution with the rotator being 800 rpm/min.

Mix 20 ml of silk fibroin solution and 10 ml of chitosan solution, and centrifuge the mixture to get rid of bubbles to obtain a spinning solution. The mass ratio of silk fibroin and chitosan is 9:1.

(2) Load the syringe with the spinning solution which is then extruded by the pump. The temperature of the copper ring is −100° C. The spinning solution passes through the copper ring, and the frozen fibers are collected by a motor.

(3) Freeze-dry the fibers obtained in step 2 for 24 h to remove ice crystal and then obtain fibers with aligned porous structure.

(4) Weave the fibers obtained in step 3 into textile.

Figure 11:
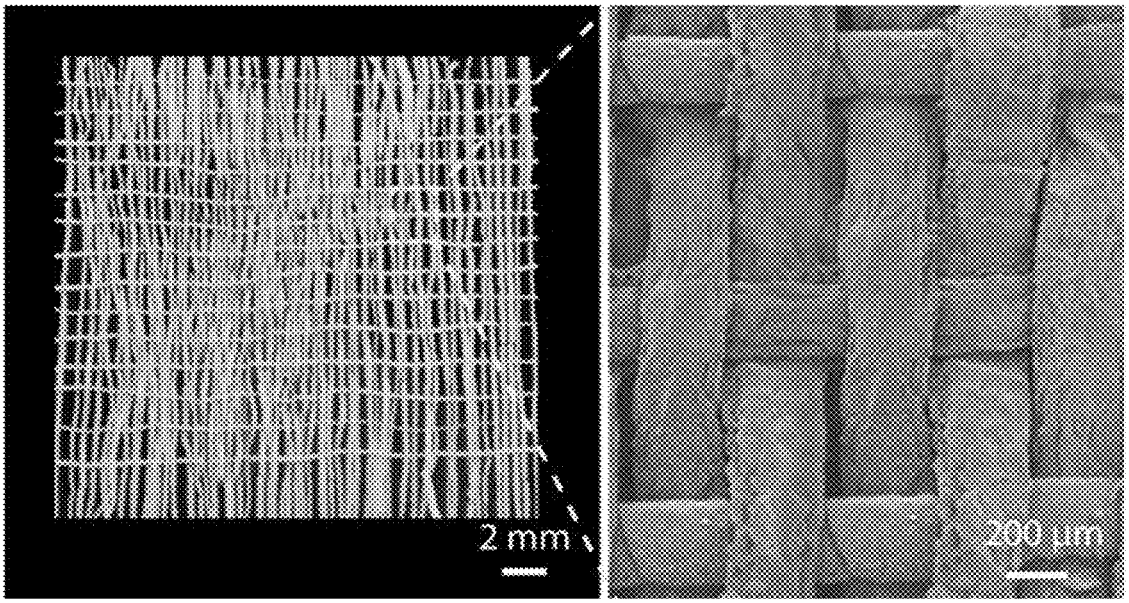
FIG. 11 shows the optical image and SEM image of textile which is woven with porous fiber fabricated in Example 9.

(5) Characterize the textile in the present example via SEM. As shown in FIG. 11, the porous fibers can be woven into wearable textile for thermal insulation.

Comparative Example 1

(1) Shear 4.5 g of natural silk cocoons. Boil the cocoons in 1 wt % sodium carbonate solution and then dry them. Dissolve them in 20 ml of 9 mol/ml lithium bromide solution, and dialyze for 24 h to make a 0.225 g/ml silk fibroin solution.

Dissolve 0.5 g of chitosan powder in 10 ml of 1 wt % acetic acid solution, and stir for 30 min for complete dissolving to form a 0.05 g/ml chitosan solution with the rotator being 800 rpm/min.

Mix 20 ml of silk fibroin solution and 10 ml of chitosan solution, and centrifuge the mixture to get rid of bubbles to obtain a spinning solution. The mass ratio of silk fibroin and chitosan is 9:1.

(2) Load the syringe with spinning solution which is then extruded directly into liquid nitrogen (−196° C.).

(3) Freeze-dry the fibers obtained in step 2 for 24 h to remove ice crystal and then obtain fibers with random porous structure.

Figure 12:
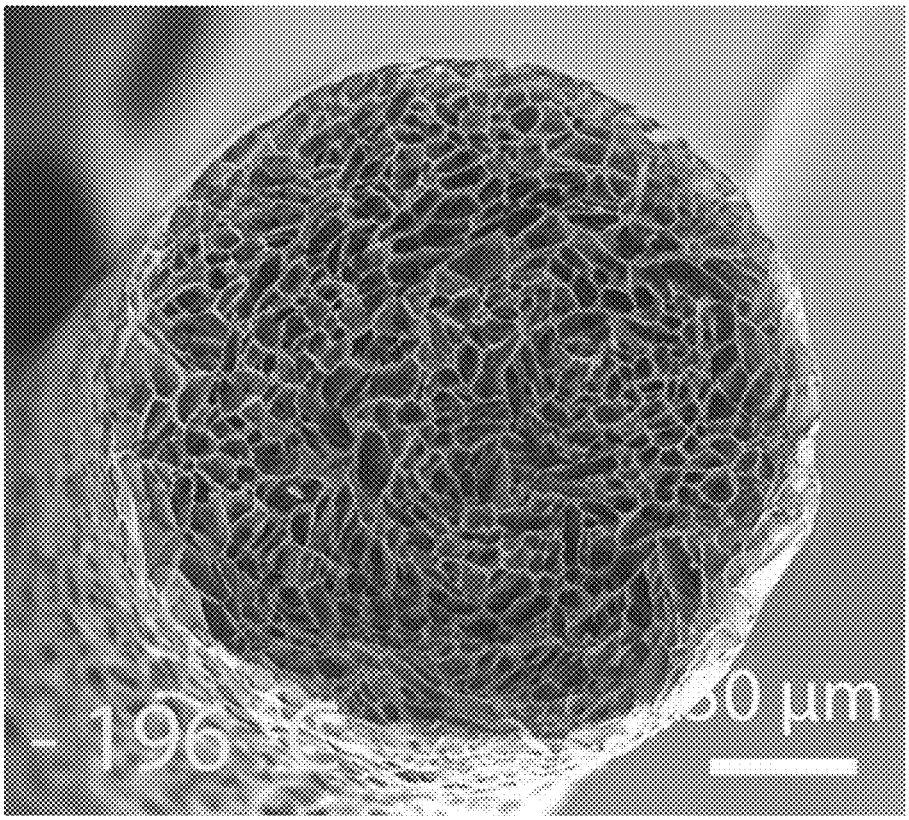
FIG. 12 shows the SEM image of porous fiber fabricated in Comparative Example 1.

(4) Characterize the porous fibers in the present comparative example via SEM. As shown in FIG. 12, the fiber has random porous structure, mainly because the freezing is along multi-direction rather than a single direction.

Application Example 1

Weave the porous fibers obtained in Example 9 into thermal-insulating textile. The porous structure and textile layers both have influence on the thermal-insulating property. Therefore, from left to right, single layer textiles with pore diameters of 85, 65, 45, 30 μm respectively, three layers textile with pore diameter of 30 μm, five layers textile with pore diameter of 30 μm are placed to test their thermal-insulating property (an area of 2×2 mm, and the thicknesses respectively are 0.4, 1.2 and 2 mm).

Figure 13:
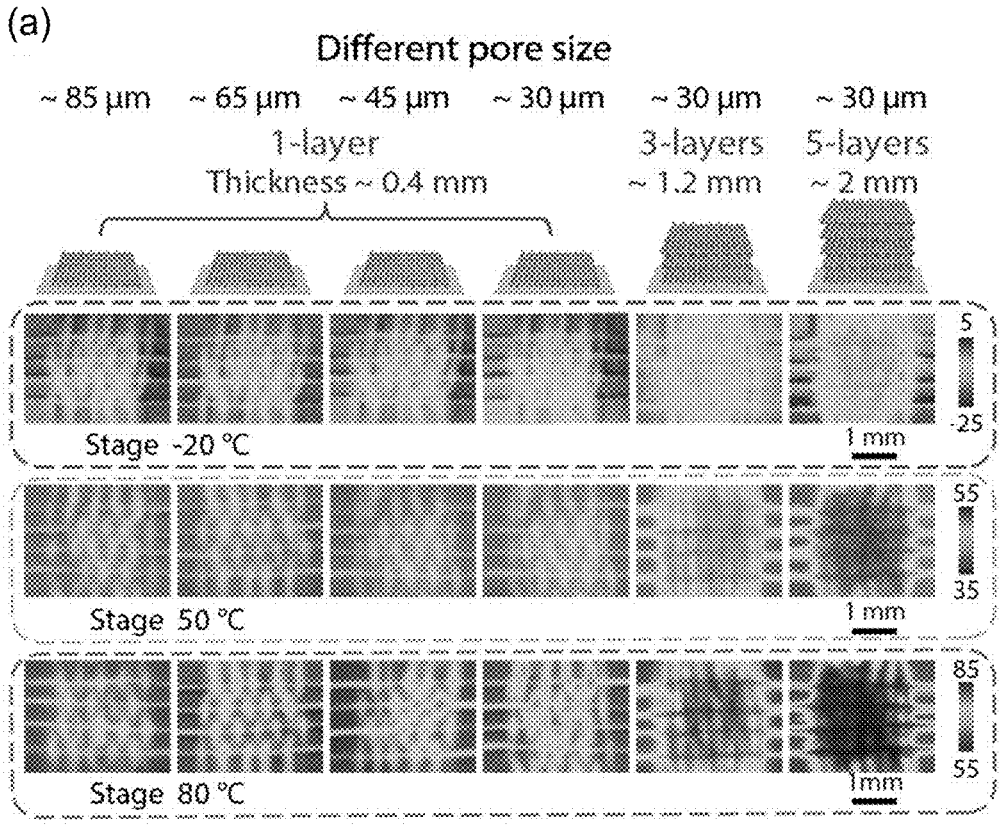
FIG. 13 shows the infrared images of thermal-insulating textile fabricated in Application Example 1 (see part (a)), and shows the statistics of absolute temperature difference (see part (b)).
Figure 13:
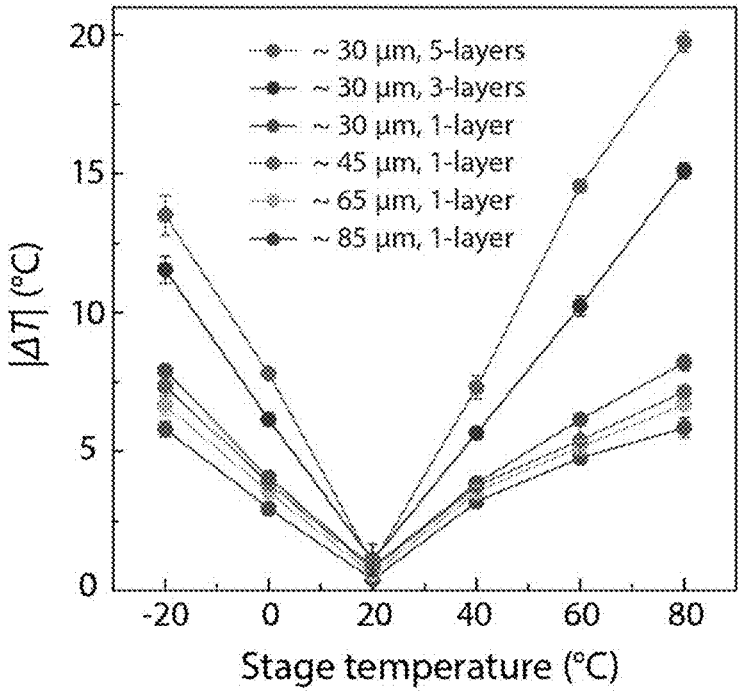

These six textiles are placed on the same hot stage for comparison, as shown in part (a) of FIG. 13. When the hot stage is heated from −20 to 80° C., a series of infrared images are obtained. When the temperatures of the hot stage respectively are −20, 50, 80° C., there are three typical infrared images. The absolute temperature differences ($|\Delta T|$) between textile surface and hot stage are counted in part (b) of FIG. 13. The temperature difference of textile woven with fibers having smaller pore diameter is greater, which means textile possesses better thermal-insulating property.

Application Example 2

Weave the porous fibers obtained in Example 9 into thermal-insulating textile. Biomimetic textile with excellent thermal-insulating property can be good option for thermal stealth material.

Figure 14:
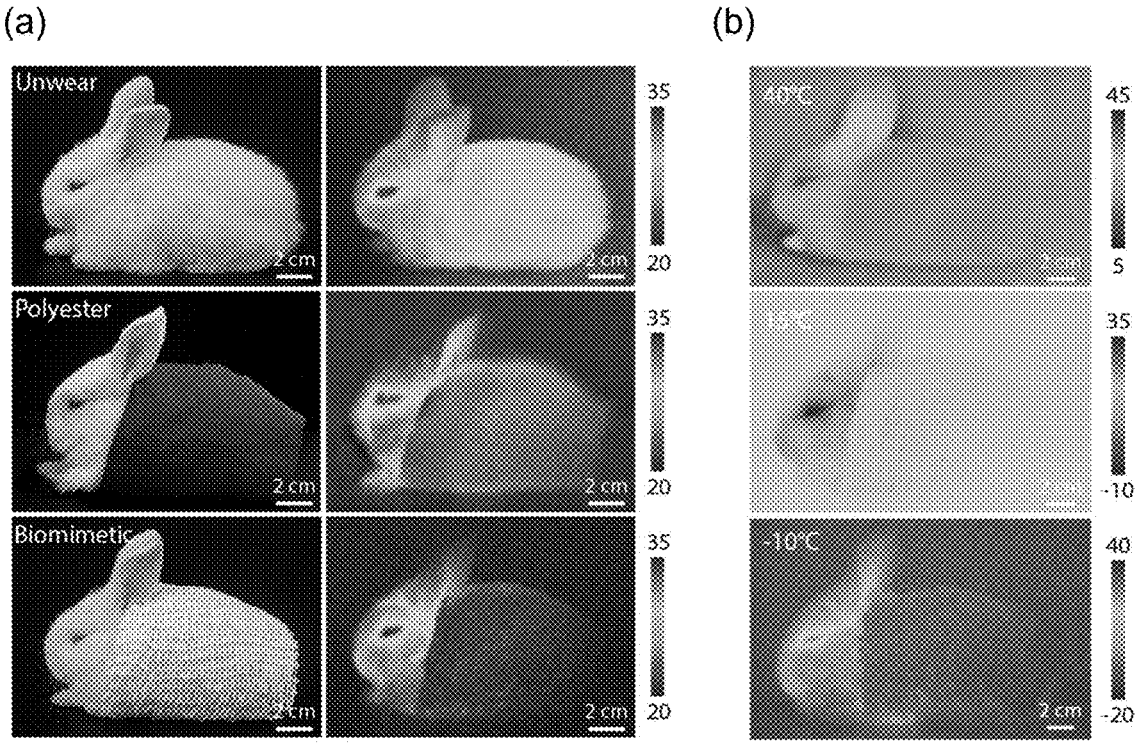
FIG. 14 shows the optical images of thermal-insulating textile used as thermal stealth material in Application Example 2 (see part (a)), and shows the corresponding infrared images (see part (b)).

As shown in part (a) of FIG. 14, a rabbit wearing a single layer of biomimetic textile and a rabbit wearing commercial polyester textile are shown in optical and infrared images. The rabbit wearing commercial polyester textile can be detected by an infrared camera. However, when the rabbit wears the biomimetic textile, it can hardly be detected, because the surface temperature of textile is closely near the environment temperature. This phenomenon indicates that the biomimetic textile can be used as thermal stealth material.

Similarly, as shown in part (b) of FIG. 14, the rabbit cannot be detected by infrared camera at different temperatures, indicating that the biomimetic textile can be used as thermal stealth material at a wide range of environment temperature from −10 to 40° C.

Application Example 3

Figure 15:
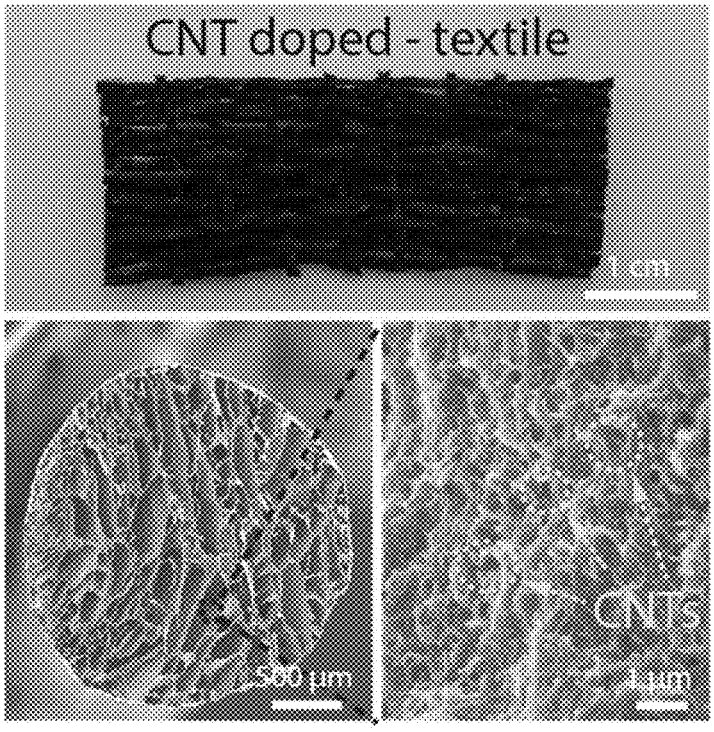
FIG. 15 shows the optical image and SEM images of porous textile doped with carbon nanotube in Application Example 3.

Weave the porous fibers in Example 8 into textile. Since the carbon nanotube is dispersed in silk fibroin solution, a conductive network forms in the textile inducing electro-thermal property. The optical and SEM images in FIG. 15 shows the carbon nanotube is dispersed and embedded well in the polymer matrix without destroying the fiber's aligned porous structure.

Figure 16:
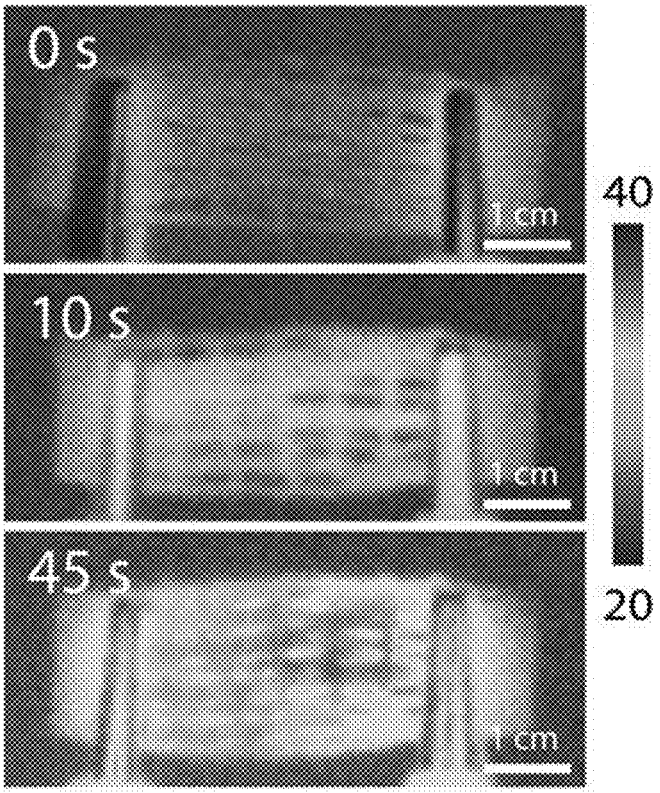
FIG. 16 shows the infrared images of porous textile doped with carbon nanotube in Application Example 3.
Figure 17:
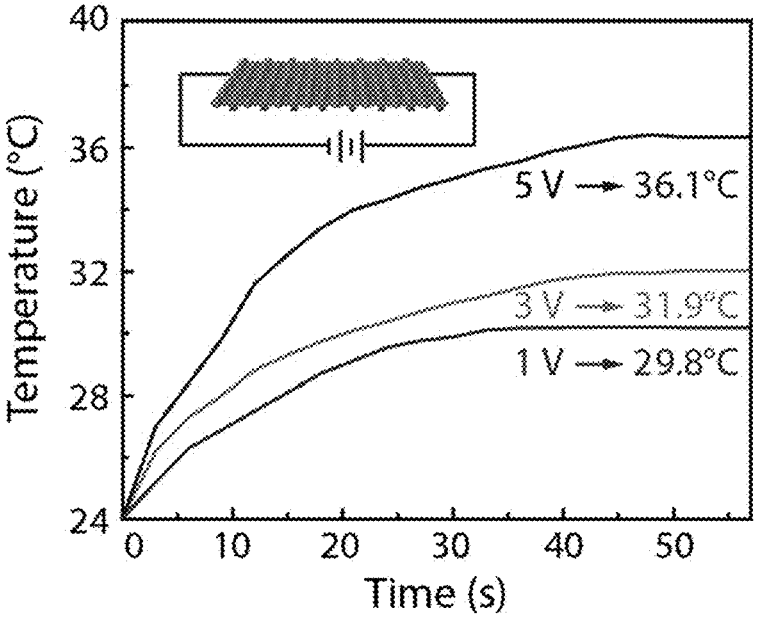
FIG. 17 shows the electrothermal property of porous textile doped with carbon nanotube under voltage in Application Example 3.

When the textile doped with carbon nanotube is connected to a circuit, as shown in FIG. 16, the surface temperature of textile increases rapidly from 20 to 36.1° C. in 45 seconds with a voltage of 5 V applied. As shown in FIG. 17, the temperature of the textile doped with carbon nanotube can be adjusted effectively by changing applied voltage.

Example 10: Preparation of the Poly(Amic Acid) Hydrogel (1) Dissolve 8.0096 g of 4,4'-diaminodiphenyl ether (ODA) in 95.57 g of N,N-dimethylacetamide (DMAc) with adding 8.8556 g of pyromellitic dianhydride (PMDA) and 4.0476 g of trimethylamine (TEA) subsequently. Stir for 4 hours to produce a viscous lightyellow poly(amic acid) (PAA) solution. Pour the as-prepared solution slowly into water to replace the solvent, and then freeze-dry it to obtain lightyellow poly(amic acid) solid.

(2) Mix 5 g of poly(amic acid) solid with 5 g of TEA and 90 g of deionized water. Stir for several hours and stand for 24 h to obtain 5 wt % poly(amic acid) hydrogel.

Example 11: Preparation of the Poly(Amic Acid) Hydrogel

The preparation is carried out according to the Example 10. The difference is that mixing 10 g of poly(amic acid) solid with 5 g of TEA and 85 g of deionized water in step 2. Stir for several hours and stand for 24 h to obtain 10 wt % poly(amic acid) hydrogel.

Example 12: Preparation of the Poly(Amic Acid) Hydrogel

The preparation is carried out according to the Example 10. The difference is that mixing 15 g of poly(amic acid) solid with 5 g of TEA and 80 g of deionized water in step 2. Stir for several hours and stand for 24 h to obtain 15 wt % poly(amic acid) hydrogel.

Example 13: Fabrication of the Polyimide Porous Fibers

The apparatus in Example 1 is selected to fabricate polyimide porous fibers. The detailed method comprises the following steps.

(1) Load the syringe with 5 wt % poly(amic acid) hydrogel in Example 10 which is then extruded by the pump. The temperature of the copper ring is −100° C. The hydrogel fibers pass through the copper ring, and the frozen fibers are collected by a motor.

(2) Freeze-dry the fibers obtained in step 1 for 24 h to remove ice crystal and then obtain fibers with aligned porous structure.

(3) Heat the as-prepared fibers to realize complete imidization of poly(amic acid) into polyimide. The thermal imidization specifically includes: heating to 100° C. at a rate of 2° C./min, maintaining 30 min; heating to 200° C. at a rate of 2° C./min, maintaining 30 min; heating to 300° C. at a rate of 2° C./min, maintaining 60 min.

Figure 18:
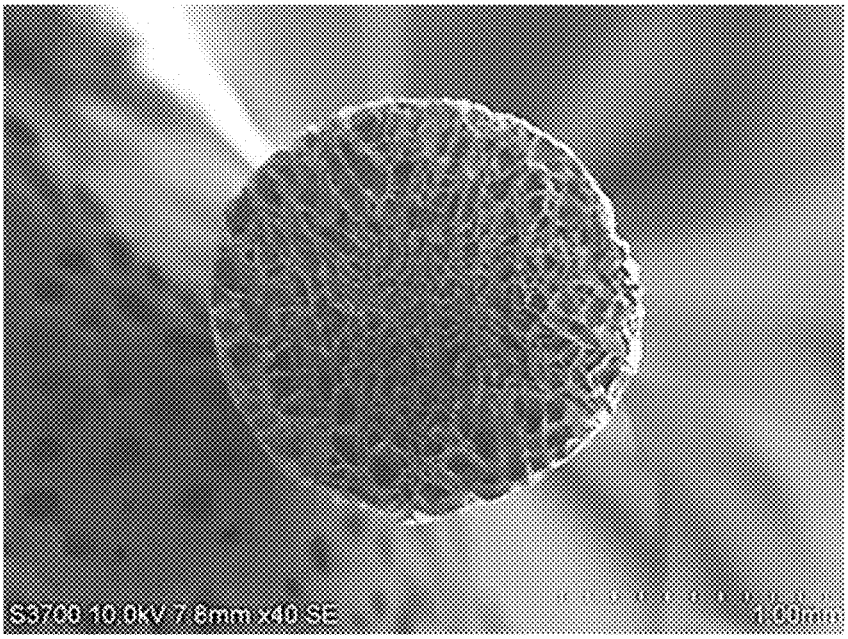
FIG. 18 shows the SEM image of porous fiber fabricated in Example 13.

(4) Characterize the polyimide porous fibers in the present example via SEM. As shown in FIG. 18, the fiber has aligned porous structure, and the pore diameter is 50~100 μm.

Example 14: Fabrication of the Polyimide Porous Fibers

The apparatus in Example 1 is selected to fabricate polyimide porous fibers. The detailed method comprises the following steps.

(1) Load the syringe with 10 wt % poly(amic acid) hydrogel in Example 11 which is then extruded by the pump. The temperature of the copper ring is −80° C. The hydrogel fibers pass through the copper ring, and the frozen fibers are collected by a motor.

(2) Freeze-dry the fibers obtained in step 1 for 24 h to remove ice crystal and then obtain fibers with aligned porous structure.

(3) Heat the as-prepared fibers to realize complete imidization of poly(amic acid) into polyimide. The thermal imidization specifically includes: heating to 100° C. at a rate of 2° C./min, maintaining 30 min; heating to 200° C. at a rate of 2° C./min, maintaining 30 min; heating to 300° C. at a rate of 2° C./min, maintaining 60 min.

Figure 19:
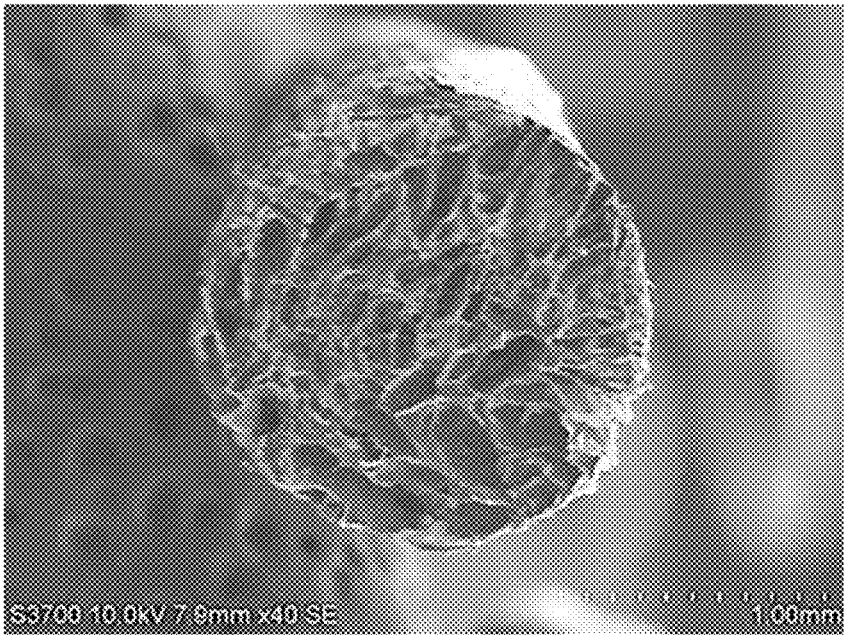
FIG. 19 shows the SEM image of porous fiber fabricated in Example 14.

(4) Characterize the polyimide porous fibers in the present example via SEM. As shown in FIG. 19, the fiber has aligned porous structure.

Example 15: Fabrication of the Polyimide Porous Fibers

The apparatus in Example 4 is selected to fabricate polyimide porous fibers. The detailed method comprises the following steps.

(1) Load the syringe with 15 wt % poly(amic acid) hydrogel in Example 12 which is then extruded by the pump. The temperature of the copper ring is −60° C. The hydrogel fibers pass through the copper ring, and the frozen fibers are collected by a motor.

(2) Freeze-dry the fibers obtained in step 1 for 24 h to remove ice crystal and then obtain fibers with aligned porous structure.

(3) Heat the as-prepared fibers to realize complete imidization of poly(amic acid) into polyimide. The thermal imidization specifically includes: heating to 100° C. at a rate of 2° C./min, maintaining 30 min; heating to 200° C. at a rate of 2° C./min, maintaining 30 min; heating to 300° C. at a rate of 2° C./min, maintaining 60 min.

Figure 20:
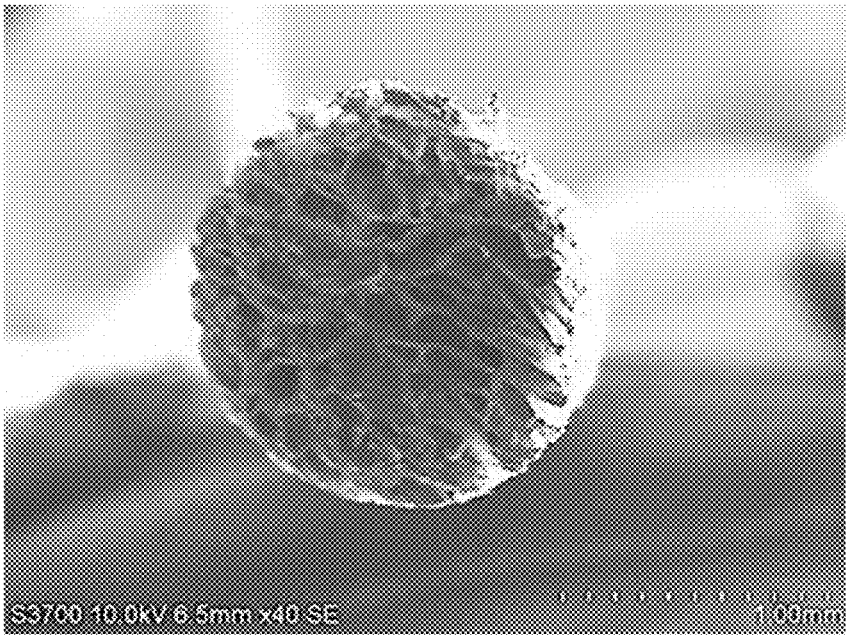
FIG. 20 shows the SEM image of porous fiber fabricated in Example 15.

(4) Characterize the polyimide porous fibers in the present example via SEM. As shown in FIG. 20, the fiber has aligned porous structure.

Example 16: Fabrication of the Polyimide Porous Fibers

The apparatus in Example 5 is selected to fabricate polyimide porous fibers. The detailed method comprises the following steps.

(1) Load the syringe with 5 wt % poly(amic acid) hydrogel in Example 10 which is then extruded by the pump. The temperature of the copper ring is −40° C. The hydrogel fibers pass through the copper ring, and the frozen fibers are collected by a motor.

(2) Freeze-dry the fibers obtained in step 1 for 24 h to remove ice crystal and then obtain fibers with aligned porous structure.

(3) Heat the as-prepared fibers to realize complete imidization of poly(amic acid) into polyimide. The thermal imidization specifically includes: heating to 100° C. at a rate of 2° C./min, maintaining 30 min; heating to 200° C. at a rate of 2° C./min, maintaining 30 min; heating to 300° C. at a rate of 2° C./min, maintaining 60 min.

Figure 21:
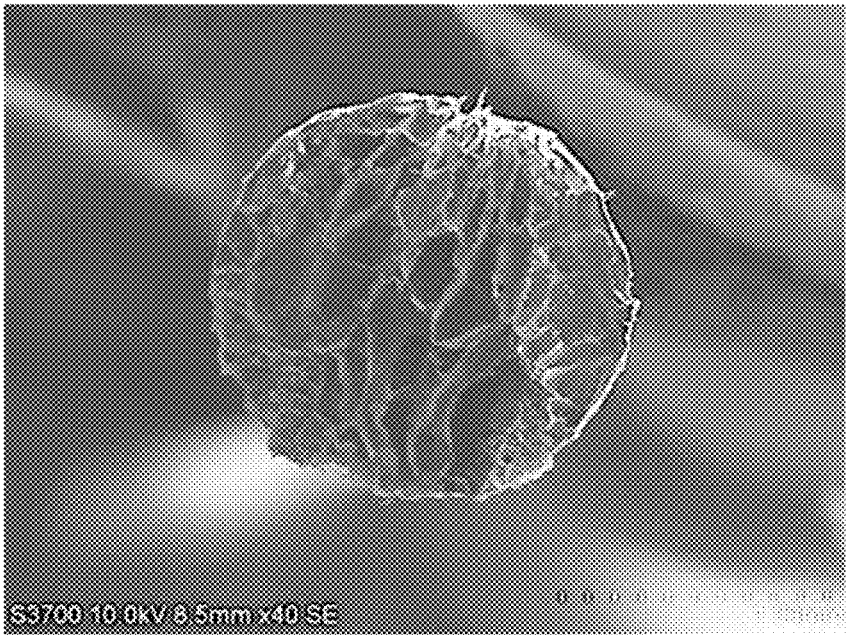
FIG. 21 shows the SEM image of porous fiber fabricated in Example 16.

(4) Characterize the polyimide porous fibers in the present example via SEM. As shown in FIG. 21, the fiber has aligned porous structure.

Figure 22:
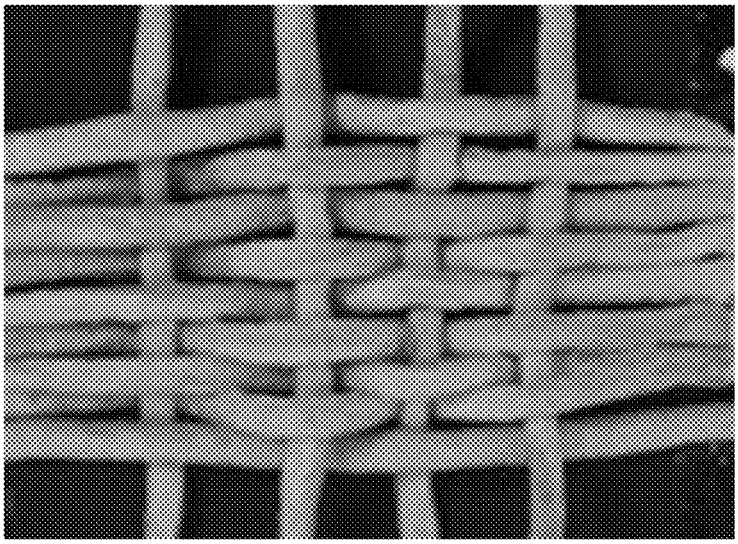
FIG. 22 shows the optical image of textile which is woven with porous fiber fabricated in Example 17.

Example 17: Fabrication of Thermal-Insulating at High Temperature and Fire-Retardant Textile Weave the polyimide porous fibers obtained in Example 13 into textile. The optical image is shown in FIG. 22.

Application Example 4

Figure 23:
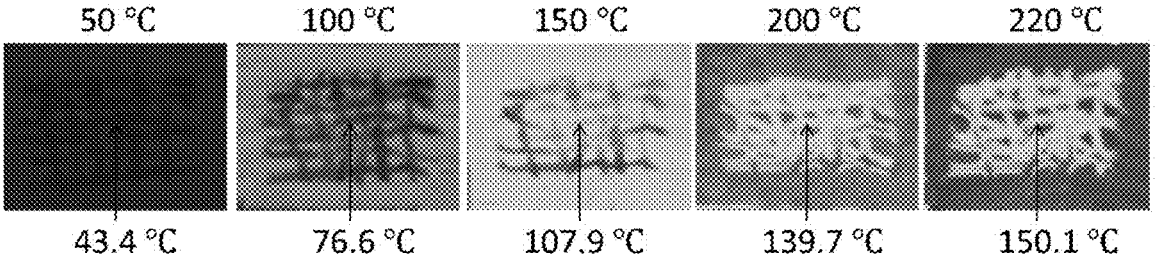
FIG. 23 shows the infrared images of textile which is woven with porous fiber fabricated in Application Example 4.
Figure 24:
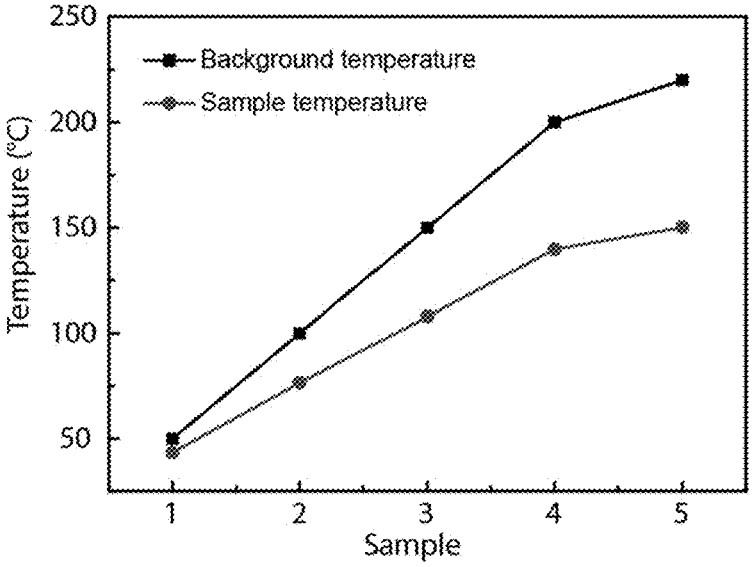
FIG. 24 shows the statistics of the temperature of the textile which is woven with porous fiber fabricated in Application Example 4 and the temperature of the hot stage.

Test the thermal-insulating property of textile in Example 17. The textile is placed on a hot stage. When the hot stage is heated from 50 to 220° C., a series of infrared images are obtained. When the temperatures of the hot stage respectively are 50, 100, 150, 200, 220° C., there are five typical infrared images, as shown in FIG. 23. The background temperature and the average surface temperature of the textile can be obtained through the infrared images and they are counted in FIG. 24. The textile possesses excellent thermal-insulating property even at high temperature.

Application Example 5

Figure 25:
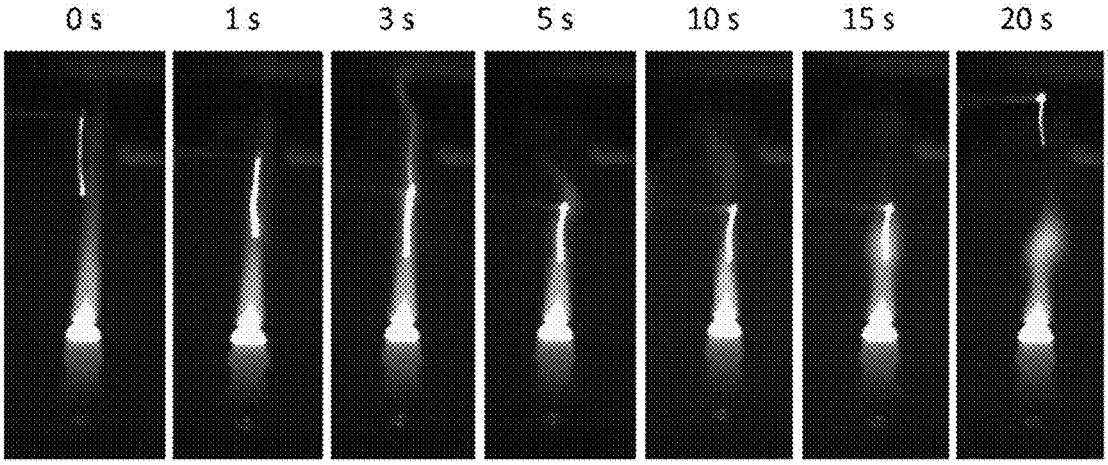
FIG. 25 shows the infrared images of burning the porous fiber in Application Example 5.

Test the fire-retardant property of polyimide porous fiber in Example 13. The polyimide porous fiber is ignited by an alcohol lamp, and a series of infrared images are obtained, as shown in FIG. 25. The fiber is not be completely burned and the morphology remains essentially unchanged. And the fiber is self-extinguishing after being removed from the fire, indicating excellent fire-retardant property of the polyimide porous fiber.

Application Example 6

Figure 26:
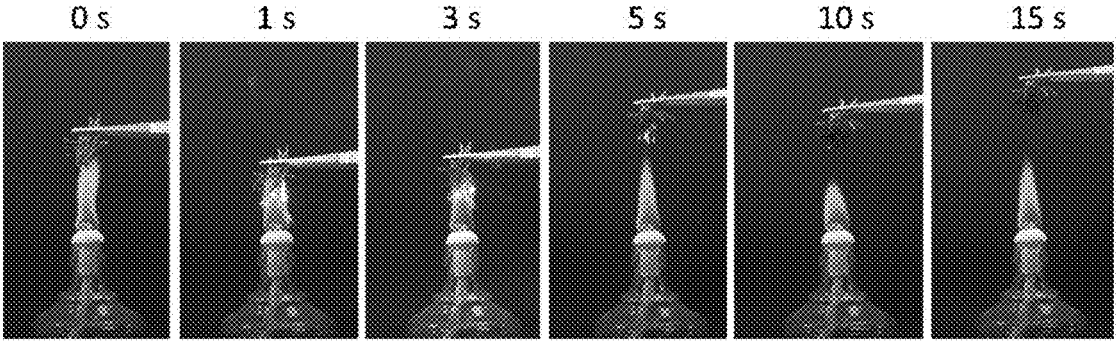
FIG. 26 shows the optical images of burning the textile which is woven with porous fiber fabricated in Application Example 6.

Test the fire-retardant property of textile in Example 17. The polyimide textile is ignited by an alcohol lamp, and a series of optical images are obtained, as shown in FIG. 26. The textile is not be completely burned and the morphology remains essentially unchanged. And the textile is self-extinguishing after being removed from the fire, indicating excellent fire-retardant property of the polyimide textile.

Comparative Example 2

Figure 27:
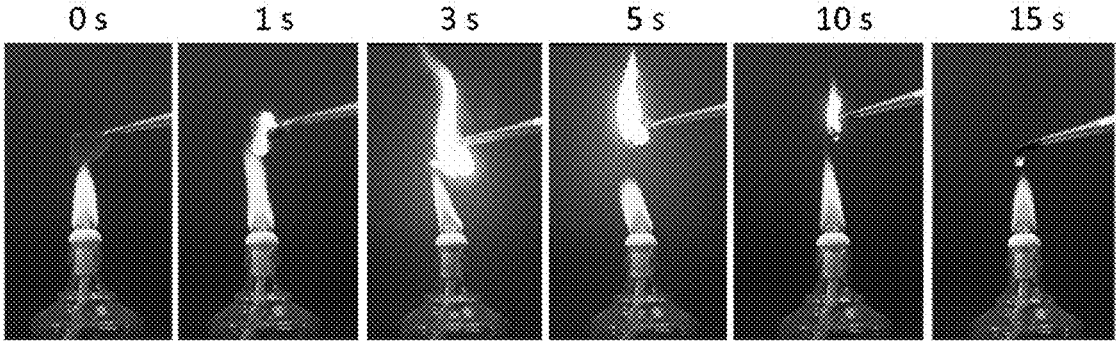
FIG. 27 shows the optical images of burning the polyester textile in Comparative Example 2.

Test the fire-retardant property of polyester textile. The polyester textile is ignited by an alcohol lamp, and a series of optical images are obtained, as shown in FIG. 27. The morphology of the polyester textile is instantly destroyed. And the flame on the textile is not extinguished after the textile being removed from the fire, indicating bad fire-retardant property of the polyester textile. As comparison, it further indicates the excellent fire-retardant property of the biomimetic polyimide textile.

What is claimed is:

1. A method of fabricating a fiber which is thermal-insulating at high temperature and fire-retardant, comprising:

(1) using a poly(amic acid) hydrogel for spinning, performing a directional freezing process during spinning, and collecting the frozen fiber, wherein the directional freezing process includes: the poly(amic acid) hydrogel passing through a freezing copper ring after being extruded from an extruder and water is frozen directionally in a direction of a temperature gradient under a temperature field;

(2) freeze-drying the frozen fiber to remove ice crystal and then obtain a fiber with aligned porous structure; and (3) heating the fiber to realize a thermal imidization of poly(amic acid) into polyimide, wherein the fiber is a polyimide porous fiber with an aligned and continuous through-hole along an axial direction.

2. The method as claimed in claim 1, wherein a preparation of the poly(amic acid) hydrogel in step 1 comprises: dissolving 4,4'-diaminodiphenyl ether in N,N-dimethylacetamide with adding pyromellitic dianhydride and trimethylamine subsequently to obtain a poly(amic acid) solid, and mixing the poly(amic acid) solid with trimethylamine and water to obtain the poly(amic acid) hydrogel.

3. The method as claimed in claim 1, wherein a temperature of the freezing copper ring is any temperature below a freezing point of water.

4. The method as claimed in claim 1, wherein the thermal imidization in step 3 is through treating the fiber with three-stage heating and three-stage constant temperature processing, and the heating and the constant temperature processing are performed alternately.

* * * * *